US006144620A

United States Patent [19]

dePoortere

[11] Patent Number: 6,144,620

[45] Date of Patent: Nov. 7, 2000

[54] APPARATUS FOR MONITORING AN ATHLETIC ACTIVITY

[76] Inventor: Thomas dePoortere, Pleasantville Rd., Green Village, N.J. 07935

[21] Appl. No.: 08/914,129

[22] Filed: Aug. 19, 1997

[51] Int. Cl.[7] ..... G04B 37/00

[52] U.S. Cl. ..... 368/108; 368/109

[58] Field of Search ..... 368/107–113

[56] References Cited

U.S. PATENT DOCUMENTS

| | | |
|---|---|---|
| 4,387,437 | 6/1983 | Lowrey et al. . |
| 4,652,141 | 3/1987 | Arai . |
| 4,731,766 | 3/1988 | Bunyea . |
| 4,991,156 | 2/1991 | Suga . |
| 5,124,960 | 6/1992 | Miller et al. . |

*Primary Examiner*—Bernard Roskoski

*Attorney, Agent, or Firm*—Dilworth & Barrese, LLP

[57] ABSTRACT

An apparatus for monitoring an athletic activity and, more particularly, to an apparatus for facilitating the refereeing of an American football game is configured to be worn on either hand of the user and to be operated thereby, and is advantageously constructed to not interfere with movement of the hand. In one preferred embodiment, the apparatus includes a housing adapted to be worn on an operator's arm, a first timer associated with the housing for counting a first predetermined period of time, an occurrence counter associated with the housing for counting an occurrence of an event, a first signalling device displaced from the housing for generating a first signal to control the first timer, a second signalling device displaced from the housing for generating a second signal to control occurrence counter and a display associated with the housing and having a first display area for displaying the time remaining of the first predetermined period of time and a second display area for displaying the number of an occurrence of an event.

32 Claims, 2 Drawing Sheets

APPARATUS FOR MONITORING AN ATHLETIC ACTIVITY

BACKGROUND OF THE INVENTION

1. Technical Field

The present invention relates to an apparatus for monitoring an athletic activity and more particularly to an apparatus for facilitating refereeing an athletic activity (e.g., an American football game).

2. Background of Related Art

Apparatuses mountable to the human body for monitoring an athletic activity, e.g., swimming, running, skiing, etc., are known. These apparatuses are useful as memory aids to check the athlete's performance or to improve the athlete's fitness in relation to his/her previous performance. They are also desirable to enhance the accuracy of the counting operation or to enhance the ability of the athlete to concentrate on other matters while maintaining an accurate count of the events or items. It is also desirable to maintain information concerning such events or items and their occurrences such as elapsed time between a particular sequence of events or items.

As an example of this type of apparatus, U.S. Pat. No. 4,681,462 discloses an apparatus with a stop watch function that can be worn on one hand of the user, preferably an athlete, so as to be operable with one hand. The apparatus has a display face and an elongate button that can be actuated by the fingers of the same hand wearing the apparatus for controlling the functioning of the stop watch and the display on the display face. A two-piece strap secures the apparatus to the user's hand by having one piece bent in a U or J shaped around the hand between the forefinger and thumb and is connected to the second piece by a stud with the second piece being secured around the wrist by a buckle.

As another example, U.S. Pat. No. 5,124,960 discloses a waterproof apparatus that is useful in counting the number of laps completed by a swimmer, i..e, the event counter, or to monitor the time elapsed when swimming, i.e., the elapsed time counter, or both. The apparatus contains a display face in the form of a wristwatch worn on the user's wrist and a digit switch module connected to the user's index finger. The digit switch module controls the function of the elapsed time counter and event counter by pressing it against either the swimmer's thumb or an object. By pressing the digit switch module in the required manner, the operator will alternatively start and stop each counter. Other types of time-keeping/monitoring apparatus are disclosed in U.S. Pat. Nos. 4,387,437; 4,652,141; 4,731,766; and 4,991,156.

SUMMARY OF THE INVENTION

Accordingly, the present invention is directed to an apparatus for monitoring an athletic activity and, more particularly, to an apparatus for facilitating the refereeing of an American football game. The apparatus is configured to be worn on either hand of the user and to be operated thereby, and is advantageously constructed to not interfere with movement of the hand. Consequently, both hands of the referee are continuously free to carry out the tasks required to officiate the football game.

In one preferred embodiment, the apparatus for monitoring an athletic activity includes a housing adapted to be worn on an operator's arm, a first timer associated with the housing for counting a first predetermined period of time, an occurrence counter associated with the housing for counting an occurrence of an event, a first signalling device displaced from the housing for generating a first signal to control the first timer, a second signalling device displaced from the housing for generating a second signal to control occurrence counter and a display associated with the housing and having a first display area for displaying the time remaining of the first predetermined period of time and a second display area for displaying the number of an occurrence of an event. Preferably, the housing is in the form of a wrist watch.

The first signalling device is adapted to be worn on one of the operator's fingers. Similarly, the second signalling device is adapted to be worn on one of the operator's fingers. Preferably, the first and second signalling devices are adapted to be worn on the same finger of the operator and manipulable by the fingers of said hand.

A second timer may also be provided and associated with the housing for counting a second predetermined period of time. In this embodiment, the display includes a third display area for displaying time remaining of the second predetermined period of time. Preferably, the second signalling device is also adapted to control the second timer.

A third timer may also be provided and associated with the housing for counting a third predetermined period of time. The third timer is preferably controlled by simultaneous actuation of the first and second signalling devices. The third display area of the housing is adapted to display time remaining of the third predetermined period of time. Preferably, a mode select switch is associated with the housing for switching the mode of third display area between a first mode wherein the time remaining of second predetermined time is displayed and a second mode wherein the time remaining of third predetermined period of time is displayed.

An alarm means may be provided for indicating when each of the first, second and third predetermined periods of time have elapsed.

In another alternate embodiment, the apparatus for refereeing an athletic activity, includes a housing adapted to be worn on an operator's wrist and being in the form of a wristwatch, a first counter associated with the housing for counting a first predetermined period of time, a second counter associated with the housing for counting a second predetermined period of time, an occurrence counter associated with the housing for counting an occurrence of an event, a third counter associated with the housing for counting a third predetermined period of time, a first signalling device adapted to be worn on one of operator's fingers to control first counter, a second signalling device adapted to be worn on one of operator's fingers to control the second counter and the occurrence counter and a display for at least displaying the time remaining of the first predetermined period of time and for displaying the number of an occurrence of an event.

BRIEF DESCRIPTION OF THE DRAWINGS

A preferred embodiment of an apparatus for monitoring an athletic activity is described below with reference to the drawings wherein.

DESCRIPTION OF THE PREFERRED EMBODIMENTS

Figure 1:
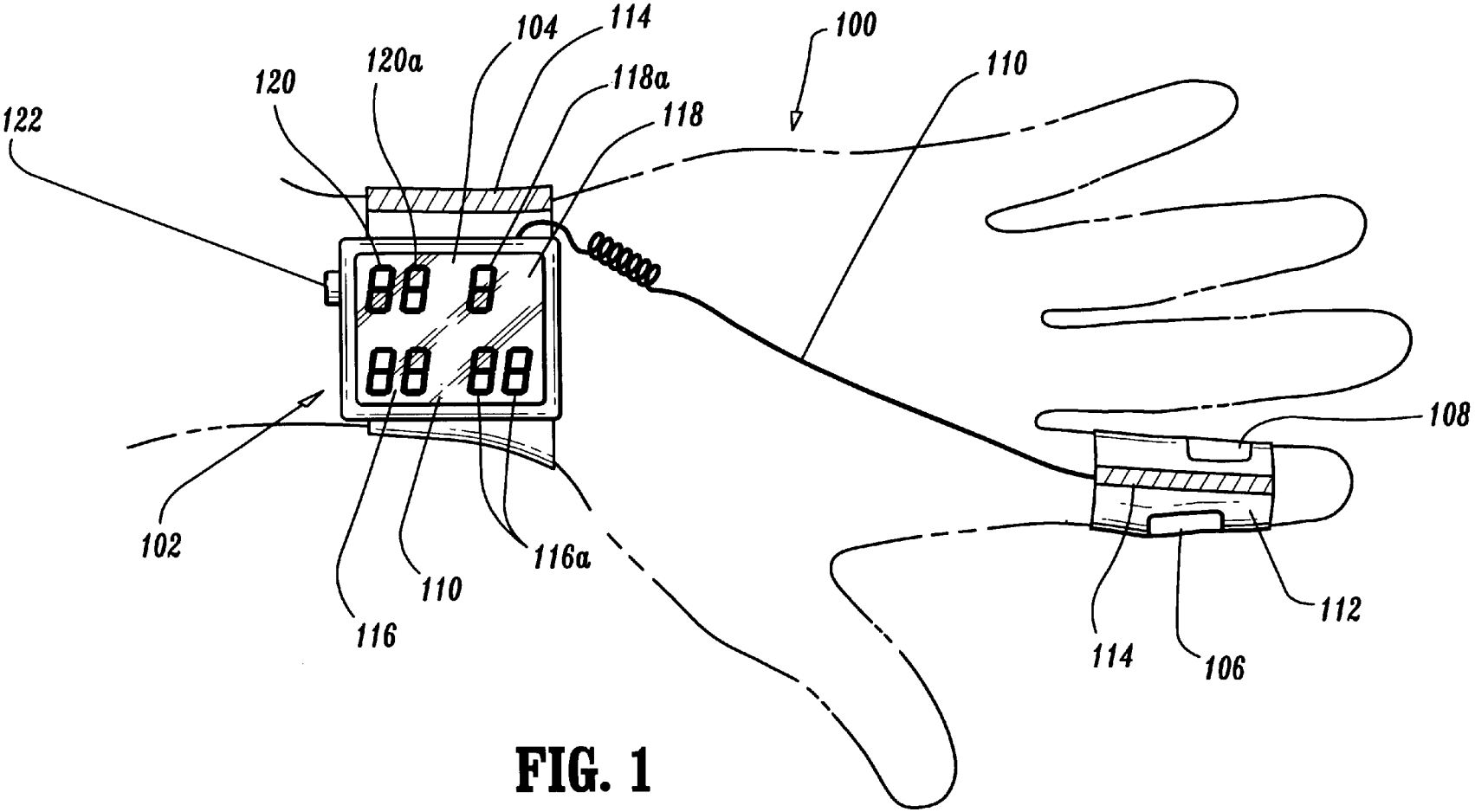
FIG. 1 is a schematic view of an apparatus for monitoring an athletic activity as worn by an operator.

Referring now to FIG. 1, an apparatus 100 for monitoring an athletic activity is shown as worn in a preferred manner by an operator on either hand. Apparatus 100 includes housing 102 having a digital display face 104 in the form of a conventional electronic LCD (liquid crystal display) watch, first signalling device (e.g., switch) 106 and second signalling device (e.g., switch) 108. First and second signalling devices 106, 108 are preferably worn around the index finger at a location where first signalling device 106 can be easily reached by the thumb of the operator and second signalling device 108 can be easily reached by the middle finger or any finger the operator may choose. Other arrangements are contemplated as well. An electronic link 110 electrically connects first and second signalling devices 106, 108 with the electronic components of housing 102.

Both housing 102 and signalling devices 106, 108 are preferably mounted on respective bands 110, 112 with Velcro™ closures 114 to securely fasten the housing 102 and the signalling devices 106, 108 to the body. Bands 110, 112 may be of any length which is suitable to encircle the portion of the body on which the operator may desire to wear the units. Bands 110, 112 may also be formed of a stretchable elastic or elasticized material such as rubber or a stretchable fabric or leather either with or without a closure formed of Velcro™ or other types of closures, as may be convenient or desirable.

Digital display face 104 includes a first display area 116 having a four digit indicator 116*a* to represent time remaining of a first predetermined period of time, a second display area 118 having a one digit indicator 118*a* to represent the cumulative total of the occurrence of an event(s) and an optional third display area 120 having two digit indicators 120*a* to represent time remaining of a second predetermined period of time, or, depending on the mode of the apparatus, the time remaining of a third predetermined period of time. It is to be understood that each digit indicator in the display areas is preferably a seven-segment digital indicator electrically driven by conventional seven-segment display driver circuitry as shown in FIG. 2 (display driver circuitry 104A).

Housing 102 further includes manually operable mode switch 122 mounted on the side of the housing. Alternate actuation or depression of switch 122 switches the mode of the switch 122 between first and second modes. In the first mode of mode select switch 122, the time remaining of the second predetermined period of time is displayed in the third display area 120. In the second mode of mode select switch 122, time remaining of the third predetermined period of time is displayed in the third display area 120. Mode switch 122 may be, in the alternative, removed from housing 102 and mounted to a band positioned about a finger as described in connection with signalling devices 106, 108 if desired. The function of mode select switch 122 will be discussed in greater detail hereinbelow.

Figure 2:
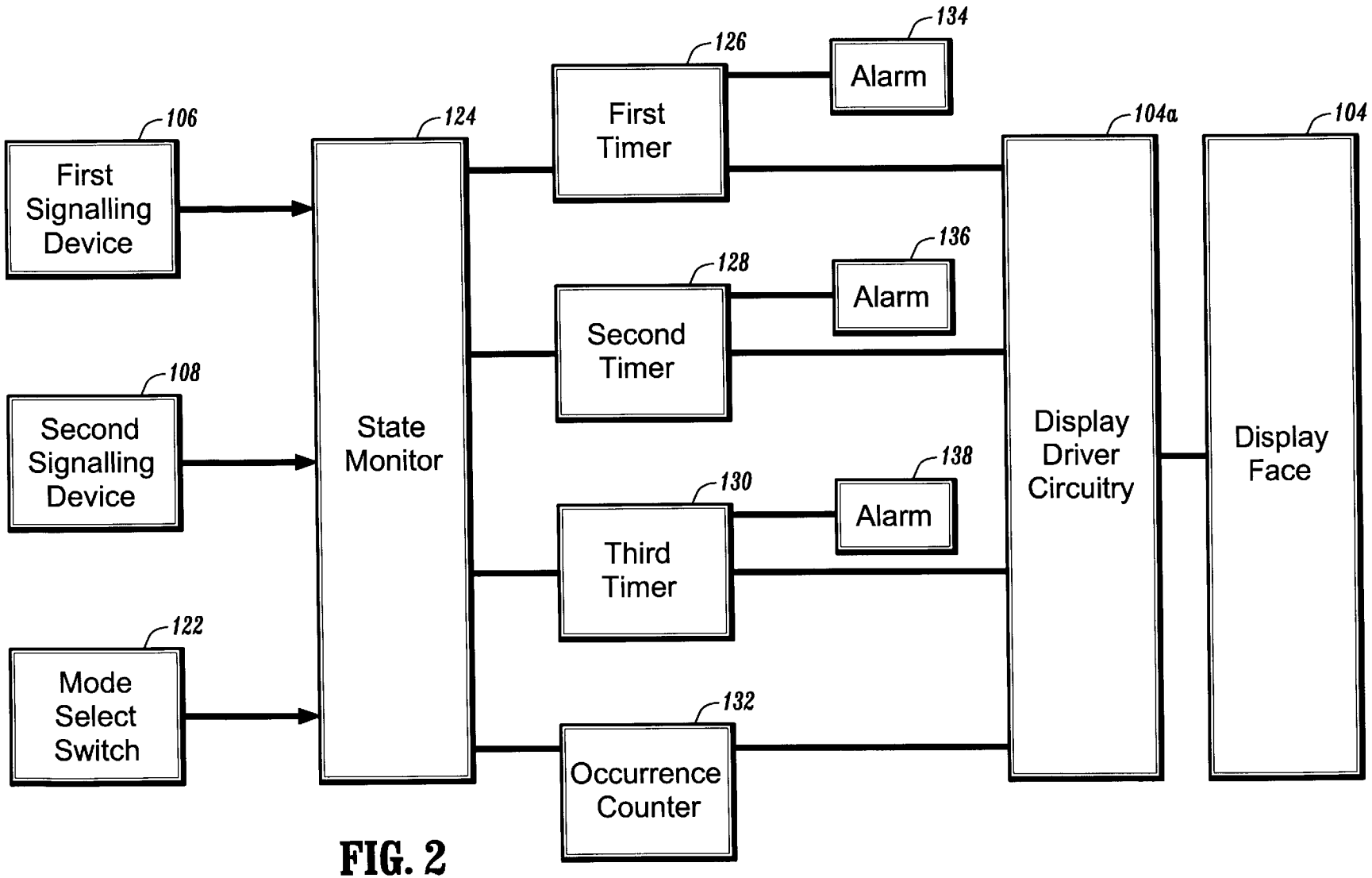
FIG. 2 is a view of a functional block diagram of a preferred embodiment of the invention.

With reference now to FIGS. 1–2, the internal electronic components of housing 102 will be discussed. Housing 102 includes state monitor 124 which receives the output of signalling devices 106, 108 and the output of mode select switch 122 and evaluates the signals transmitted thereby. State monitor 124, in turn, provides enabling signals to other functional elements within housing 102 as desired. These other functional elements may include conventional timekeeper circuitry consisting of first timer 126, second timer 128 and third timer 130, and occurrence counter 132 which is associated with second timer 128 as will be appreciated from the description provided hereinbelow. It is to be appreciated that the state monitor 124 may be in the form of conventional digital logic circuitry which may be implemented by one of ordinary skill in the art given the functional descriptions provided herein. Alternatively, the state monitor 124 may be in the form of a microprocessor (or other programmable controller) capable of receiving the input signals described, processing the signals and outputting appropriate output signals in response thereto. For that matter, other functional modules described herein and illustrated in FIG. 2 may be implemented by a microprocessor, e.g., timers, counters and/or alarms.

First timer 126 counts time remaining of a first predetermined period of time, e.g., fifteen minutes corresponding to one quarter of a professional football game, with the time remaining being continually displayed by first display area 116 of the digit display face 104. First timer 126 is controlled by signalling device 106 whereby actuation or depression of signalling device 106 will alternately stop and start counting of the first predetermined period of time. Preferably, an alarm 134 is associated with first timer 126 and is actuated when the first predetermined period of time has elapsed. Conventional circuitry for activating the alarm is appreciated by one skilled in the art. Alarm 134 may be an audio, visual or vibratory alarm. Upon the elapsing of the first predetermined period of time, first timer 126 is automatically reset, e.g., to fifteen minutes. Alternatively, first timer 126 may be reset by depressing and holding first signalling device 106 for a short period, e.g., from about 2 to about 7 seconds.

Second timer 128 counts time remaining of the second predetermined period of time, e.g., a twenty-five (25) second play clock in a professional football game, with the time remaining being displayed by third display area 120 of housing 102. It is to be noted that third display area 120 will display the time remaining of the second predetermined period of time when mode select switch 122 is in a first mode, i.e., mode A. Second timer 128 is controlled by signalling device 108. Depression of signalling device 108 starts second timer 128. Similar to first timer 126, an alarm 136 may be associated with second timer 128 to indicate when the second predetermined period of time has elapsed. Second timer 128 automatically resets upon the elapse of the second predetermined period of time or can be reset by depressing and holding second signalling device 108 for a short period, e.g., from about 2 to about 7 seconds.

Third timer 130 counts time remaining of a third predetermined period of time, e.g., a sixty (60) second time out, e.g., a TV timeout, in a professional football game. Third timer 130 is actuated by the simultaneous actuation or depression of first and second signalling devices 106, 108. Conventional circuitry or a microprocessor forming state monitor 124, to accomplish this objective, is appreciated by one skilled in the art. An alarm 138 may also be associated with third timer 130 to indicate when the third predetermined time has elapsed. The time remaining for the third predetermined period of time may be displayed on the third display 120 of housing 102. Mode select switch 122 may be depressed to switch to display this time, i.e., by depressing mode select switch 122 to switch to mode B the time remaining of the third predetermined period of time is displayed on third display.

Occurrence counter 130 counts the occurrence of an event, e.g., the number of downs during a play sequence, e.g., 1–4, the cumulative total being displayed on second display 126. Occurrence counter 130 may be any conventional counter appreciated by one skilled in the art or may be implemented as a function performed by a microprocessor. Occurrence counter 132 is controlled by second signalling device 106. In particular, a single depression of second signalling device 106 will advance by one the count of the event, e.g., from down number 1 to down number 2. (As indicated above, actuation of second signalling device 106 also starts second timer, e.g., the play clock.) Occurrence counter 132 automatically resets to 1 (down 1) upon advancement beyond 4 (down 4). It is also envisioned that occurrence counter 132 may be reset, e.g., back to 1, by depressing the second signalling device 106 and holding the device 106 in the depressed position for about 2–7 seconds. It is further envisioned that occurrence counter 132 may be maintained at the same number by depressing second signalling device 106 twice in succession. Conventional circuity appreciated by one skilled in the art or a microprocessor may be utilized to achieve these objectives.

Operation of Apparatus

The apparatus of the present invention will be better appreciated by the following description of same in conjunction with the use thereof in refereeing an American football game.

Initially, the offensive team has the ball on first down and is about to commence a play. When the play is started, the referee actuates first signalling device 106 which activates first timer 124. The play finishes without the offense gaining sufficient yardage to obtain a first down. Thus, it is second down. Accordingly, the referee actuates second signalling device 108 with, preferably, his/her middle finger, which advances occurrence counter by one, i.e., from 1 to 2, with the numeral "2" being displayed on the second display 118. As stated above, actuation of second signalling device 108 also initiates the running of the second timer 126 corresponding to the twenty-five second clock—the period of time in which the offense has to commence a play. The time remaining of the second predetermined period of time is displayed on third display 120 of housing 102 when, as stated above, mode select switch 122 is in mode A. The referee may monitor the time remaining of the second predetermined period of time to ensure that the offense initiates the next play before the second predetermined period of time elapses. Additionally, as stated above an alarm may be incorporated to further assist the referee when this time has elapsed. The offense may initiate the next play and the referee will operate the apparatus in the same manner.

In the occurrence of a penalty which cause the replay of a down, the referee may actuate the second signalling device 108 twice in succession to maintain the occurrence counter 120 at the same count. In the event of obtaining sufficient yardage to obtain a first down, the referee will depress second signalling device for a period of time, e.g., from about 2–7 seconds, which effectuates resetting of the occurrence counter to one. If a timeout is called by either team, the referee simultaneously depresses first and second signalling devices 106, 108 which activates third timer 128 to count the third predetermined period of time, e.g., 60 second time out. The referee may monitor the third predetermined period of time on third display area which is switched to the proper display mode B by switch 122. Any time stoppages in the quarter, e.g., out-of-bounds, change of possession, time out, is affected by depression of first signalling device 106. When time elapses in the quarter, the first timer 124 automatically returns to 15 minutes (first predetermined period of time).

Thus, the apparatus of the present invention facilitates the refereeing of a sporting event, in particular, an American football game. By the strategic positioning of the signalling devices 106, 108 on the finger of the user, the referee has use of both hands to catch and hold the ball or make whatever signalling motions with his/her hands necessary during refereeing of the game. Actuation of the signalling devices 106, 108 is effectuated by simple manipulation of the fingers of the user.

While the above description contains many specifics, these specifics should not be construed as limitations on the scope of the disclosure, but merely as exemplifications of preferred embodiments therefor. For example, it is envisioned that the apparatus may be adapted for other sporting events including soccer, basketball, lacrosse etc. . . . The first, second and third predetermined periods of time may be modified to correspond to collegiate football games as well. Those skilled in the art will envision many other possible variations that are within the scope and spirit of the disclosure as defined by the claims appended hereto.

What is claimed is:

1. An apparatus for monitoring an athletic activity, which comprises:

(a) a housing adopted to be worn on an operator's arm;

(b) a first timer within said housing for counting a first predetermined period of time;

(c) a second time within said housing for counting a second predetermined period of time;

(d) an occurrence counter within said housing for counting an occurrence of an event;

(e) a first signaling device displaced from said housing for generating a first signal to control said first timer;

(f) a second signaling device displaced from said housing for generating a second signal to initiate said occurrence counter and said second timer; and (g) a display within said housing and having a first display area for displaying the time remaining of said first predetermined period of time and a second display area for simultaneously displaying a number relating to the cumulative total of the occurrence of the event.

2. The apparatus of claim 1 wherein said housing is in the general form of a wrist watch.

3. The apparatus of claim 1 wherein said first signalling device is adapted to be worn on one of the operator's fingers.

4. The apparatus of claim 3 wherein said second signalling device is adapted to be worn on one of the operator's fingers.

5. The apparatus of claim 4 wherein said first and second signalling device are adapted to be worn on the same finger of the operator.

6. The apparatus of claim 1 wherein said display includes a third display area for displaying time remaining of said second predetermined period of time.

7. The apparatus of claim 6 including a third timer within said housing for counting a third predetermined period of time.

8. The apparatus of claim 7, wherein said third timer is controlled by simultaneous actuation of said first and second signalling devices.

9. The apparatus of claim 8 wherein said third display area of said housing is adapted to display time remaining of said third predetermined period of time.

10. The apparatus of claim 9 including a mode select switch mounted to said housing for switching the mode of said third display area between a first mode wherein the time remaining of said second predetermined time is displayed and a second mode wherein the time remaining of said third predetermined period of time is displayed.

11. The apparatus of claim 1 further including an alarm for indicating when said first predetermined period of time has elapsed.

12. The apparatus of claim 1 further including an alarm for indicating when said second predetermined period of time has elapsed.

13. The apparatus according to claim 1 wherein said display is adapted to display a number equal to the cumulative total of the occurrences of an event plus one.

14. The apparatus according to claim 13 wherein said first and second signalling devices are adapted to be worn on the same finger of the official.

15. An apparatus for officiating an American football game, characterized by being played by opposing teams for a plurality of quarter time periods and wherein each team alternates in executing a series of downs in an attempt to advance the football to score points, the apparatus comprising:

(a) a housing adapted to be worn adjacent an official's wrist;

(b) a first timer internal to said housing for counting a first predetermined period of time corresponding to a quarter time period of the football game;

(c) a second timer internal to said housing for counting a second predetermined period of time corresponding to the time period in which a team must initiate a down;

(d) an occurrence counter internal to said housing for registering a number representative of the cumulative total of downs executed in the series;

(e) a first signalling device adapted to be worn on one of said official's fingers to initiate said first timer;

(f) a second signalling device adapted to be worn on one of said official's fingers to control said second timer and said occurrence counter; and (g) a display internal to said housing for at least displaying the time remaining of said first predetermined period of time and for at least displaying said number representative of the cumulative total of downs executed in the series.

16. The apparatus of claim 15 wherein said first predetermined period of time ranges from about 12 to about 16 minutes.

17. The apparatus of claim 15 wherein said second predetermined period of time ranges from about 15 to about 45 seconds.

18. The apparatus according to claim 15 further including a third timer internal to said housing for counting a third predetermined period of time corresponding to a play stoppage.

19. The apparatus of claim 18 wherein said third predetermined period of time range from about 50 to 70 seconds.

20. The apparatus according to claim 18 wherein said third timer is controlled by actuation of said first and second signalling devices.

21. The apparatus according to claim 18 wherein said display is adapted to display time remaining of said third predetermined period of time.

22. The apparatus according to claim 21 including a mode select switch associated with said housing for selectively displaying either the time remaining of said second predetermined period of time or the time remaining of said third predetermined period of time.

23. The apparatus according to claim 15 wherein said number displayed by said display represents a successive down to be executed in the series, said number being equal to the cumulative total of downs plus one.

24. The apparatus of claim 23 wherein said number displayed by said display ranges from 1 to 4.

25. The apparatus according to claim 24 wherein said occurrence counter is adapted to reset to the numeral one indicating a first down.

26. An apparatus for officiating an American football game, characterized by being played by opposing teams for a plurality of quarter time periods and wherein each team alternates in executing a series of downs in an attempt to advance the football to score points, the apparatus comprising:

(a) a housing adapted to be worn adjacent an official's wrist;

(b) a first timer internal to said housing for counting a first predetermined period of time corresponding to a quarter time period of the football game;

(c) a second timer internal to said housing for counting a second predetermined period of time corresponding to the time period in which a team must initiate a down;

(d) an occurrence counter internal to said housing for registering a number representative of the cumulative total of downs executed in the series;

(e) a first signaling device to initiate said first timer;

(f) a second signaling device to initiate said second timer and said occurrence counter;

(g) a display internal to said housing for at least displaying the time remaining of said first predetermined period of time and for at least displaying said number representative of the cumulative total of downs executed in the series; and (h) at least one of the first and second signaling devices being displaced from said housing.

27. The apparatus according to claim 26 wherein the at least one of the first and second signaling devices is adapted to be worn on one of said official's fingers.

28. The apparatus according to claim 26 further including a third timer internal to said housing for counting a third predetermined period of time corresponding to a play stoppage.

29. The apparatus according to claim 28 wherein said third timer is controlled by actuation of said first and second signalling devices.

30. The apparatus according to claim 28 wherein said display is adapted to display time remaining of said third predetermined period of time.

31. The apparatus according to claim 30 including a mode select switch associated with said housing for selectively displaying either the time remaining of said second predetermined period of time or the time remaining of said third predetermined period of time.

32. The apparatus according to claim 26 wherein said number displayed by said display represents a successive down to be executed in the series, said number being equal to the cumulative total of downs plus one.

* * * * *